United States Patent [19]

Stephens et al.

[11] 3,950,744

[45] Apr. 13, 1976

[54] MODULAR BUZZER WITH DIAPHRAGM MOLDED INTO HOUSING

[75] Inventors: Gerald D. Stephens, Vandalia; Ivan L. Clark, Dayton, both of Ohio

[73] Assignee: Projects Unlimited, Inc., Dayton, Ohio

[22] Filed: June 14, 1974

[21] Appl. No.: 479,273

[52] U.S. Cl. ..... 340/392; 340/388; 340/402

[51] Int. Cl.[2] ..... G10K 9/12

[58] Field of Search..... 340/384 K, 392, 402, 400, 340/388; 58/38

[56] References Cited

UNITED STATES PATENTS

| | | | |
|---|---|---|---|
| 3,533,103 | 10/1970 | Hayden | 340/384 R |
| 3,564,542 | 2/1971 | Arai | 340/392 |
| 3,577,725 | 5/1971 | Ganter | 340/392 X |
| 3,760,411 | 9/1973 | Youhanaian | 340/402 X |
| 3,774,200 | 11/1973 | Heath | 340/384 R |

OTHER PUBLICATIONS

*Electronics*, May 29, 1973, p. 164.

*Primary Examiner*—John W. Caldwell
*Assistant Examiner*—William M. Wannisky
*Attorney, Agent, or Firm*—Biebel, French & Bugg

[57] ABSTRACT

A modular buzzer device which includes a striker arm, a diaphragm, and electromagnetic means for oscillating the striker arm. The device is housed in a container with a shape and size corresponding to a common electronic component configuration. The diaphragm is molded onto the housing and forms the top wall thereof. The striker arm is welded to one leg of an iron core used in oscillating the striker arm.

1 Claim, 4 Drawing Figures

MODULAR BUZZER WITH DIAPHRAGM MOLDED INTO HOUSING

BACKGROUND OF THE INVENTION

This invention relates to a buzzer enclosed in a modular-type housing with sound originating from a diaphragm impacted by an electromagnetically excited striker arm.

Although prior art includes buzzers which have many of the same elements as are present in this invention, the utility of such buzzers was somewhat limited by costs attributed to a relatively large number of parts and the lack of a standard size and construction conforming to electronic components so that they could be easily mounted or replaced on prefabricated circuits.

Prior buzzers placed the diaphragm within the container, with both striker arm and diaphragm mounted by fasteners. Such a construction increased both material costs and labor costs for the time spent in manufacture.

Connection of the buzzer to the electrical circuit was accomplished by wire leads which protruded from the housing of the buzzer. The leads were required to be hand-soldered to the circuit, which increased both the time and cost in connecting the buzzer.

U.S. Pat. No. 3,564,542, issued Feb. 16, 1971, discloses a buzzer device similar to the present invention, with the diaphragm secured to the housing by a cover which is itself fastened by screws.

In U.S. Pat. No. 3,530,463, issued Sept. 22, 1970, the diaphragm is glued to a support member which is fastened to the housing by screws.

In both of the above inventions, the number of parts required for construction of the buzzer is greater than the present invention, and there is no disclosure of a shape or size so as to make the buzzer readily mounted or replaced.

SUMMARY OF THE INVENTION

The present invention is both more simple in design and of such a construction that it is easily adopted for use with prefabricated circuits.

The standard base size allows the buzzer to be either inserted into a socket with receptacles corresponding to the buzzer's connection pins or easily mounted on a circuit board, as well as connected by conventional methods.

The simple design of the buzzer allows a reduction in the cost of the buzzer by elimination of the cover which normally forms the top wall of the top wall of the housing, and the fasteners which hold the diaphragm and striker arm in place.

These design changes do not, however, affect the quality of the buzzer. It retains the important characteristics of previous buzzers in that it emits a sound which is clearly audible to persons in the immediate vicinity.

The buzzer can be operated by various common solid state circuits, which are not the subject of this invention.

The object of the present invention is to provide a solid state buzzer at a reduced cost; and to provide a buzzer which can be more readily used in prefabricated circuits, allowing easy mounting or replacement directly in standard circuit configurations or sockets.

Other objects and advantages of the invention will be apparent from the following description, the accompanying drawings and the appended claims.

DESCRIPTION OF THE PREFERRED EMBODIMENTS

Figure 1:
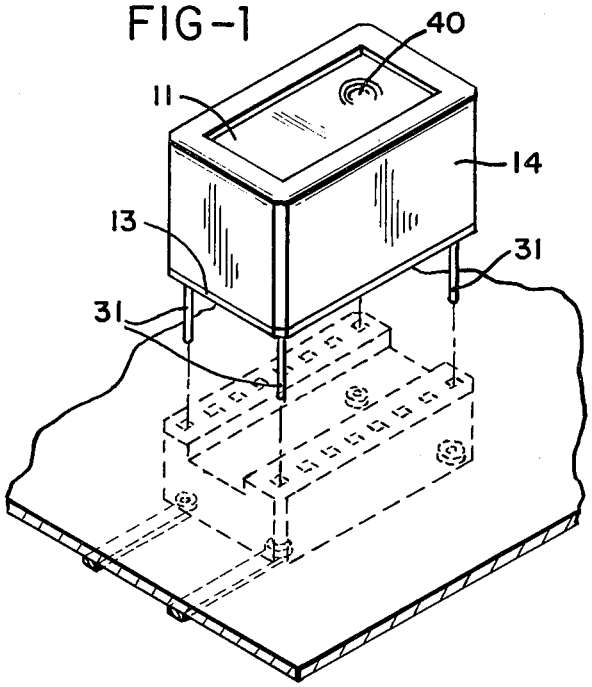
FIG. 1 is a perspective view of the outside appearance of the buzzer and its possible use with a socket corresponding to circuit pins arranged in a standard dual-inline package configuration.
Figure 2:
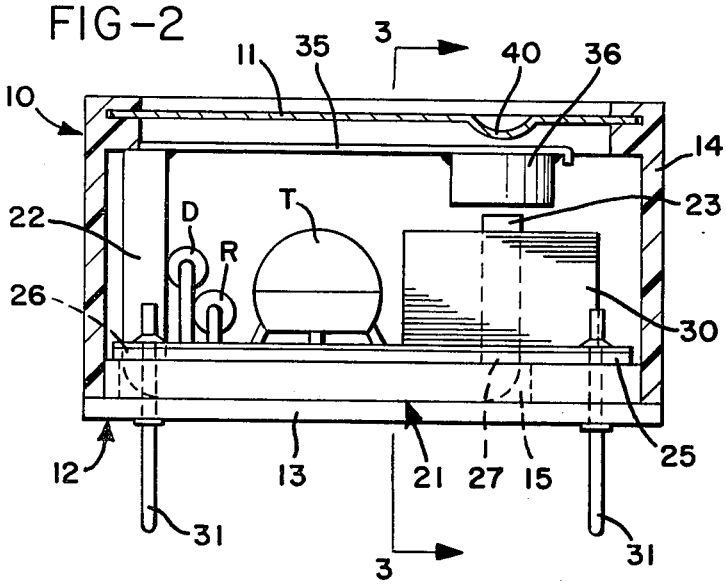
FIG. 2 is a longitudinal sectional view of the buzzer.
Figure 3:
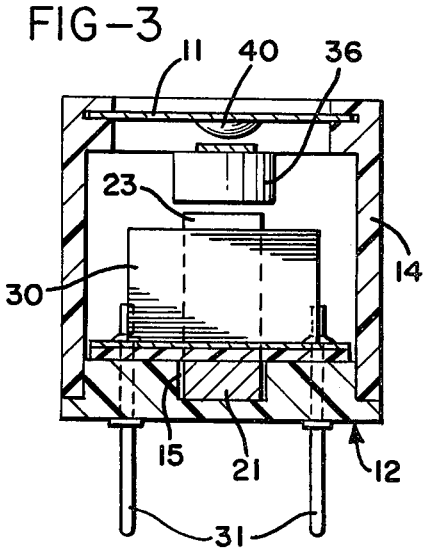
FIG. 3 is a sectional view taken along lines 3—3 of FIG. 2.

The buzzer, as represented in FIGS. 1 through 3 consists of a base assembly 12 onto which a housing 10 has been secured by a suitable cement, or by electronic welding, or some other suitable means. The top wall of the housing 10 consists of a metal diaphragm 11 which is molded into the plastic side walls 14 of the housing. Other suitable materials can be used for the diaphragm.

The base assembly consists of a plastic base 13 with a recess 15, such that a U-shaped iron core 21 fits into the base. A circuit board 25, with a slot 26 on one end and a hole 27 near the other end, is fitted over the iron core 21 and onto the base, such that the long iron core leg 22 fits through the slot 26 and the short iron core leg 23 fits through the hole 27.

Figure 4:
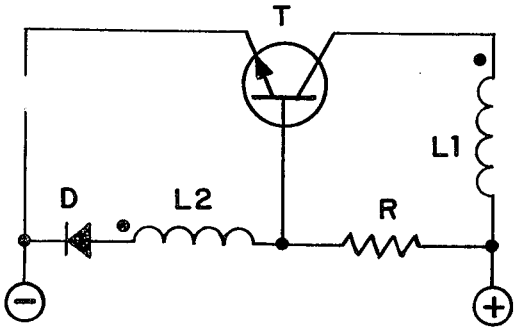
FIG. 4 is a diagram showing one of many possible circuits which could be used to operate the buzzer.

A set 30 of two windings is placed around the short iron core leg and is incorporated in the circuit which operates the buzzer. The individual windings are represented in FIG. 4 by L1 and L2. Circuit connection pins 31, which fit through holes in the circuit board 25 and plastic base 13, project from the plastic base and connect the circuit to an external power source, for example through some form of condition responsive switching mechanism (not shown) which will apply power to the circuit in response to the existence of some condition as to which a warning is desired.

One end of a striker arm 35 is welded to the longer core leg 22, and a magnet 36 is secured to the other end of the striker arm, positioned such that directly above the striker arm and magnet is the apex of a circular recess of dimple 40 in the diaphragm 11, and directly below is the shorter core leg 23. Thus the core and magnet form the magnetic circuit, and with an oscillating magnetic field induced in the core 21, the magnet secured to the striker arm is alternatively attracted and repelled from the core leg 23, and will strike diaphragm 11 in such a manner to produce an audible sound. It is possible to form the dimple on arm 35, rather than in the diaphragm 11, the purpose of the dimple being to cause the striker arm to contact as nearly as possible to the center of the diaphragm, thus producing the maximum amount of deflection of the diaphragm and hence producing as much audible output as possible. In an actual embodiment, for economy in manufacturing, it has been found desirable to locate the dimple in the diaphragm.

The set of windings 30 preferably is formed as a pair of bifilar windings which are cement coated, and form wound, thereby providing a suitable set of windings at minimum cost, and within a small dimension. The windings are self-supporting and can readily be slipped over the core leg 22, with their leads soldered to the appropriate points on the circuit board 25. The use of a bifilar winding is primarily an advantage from the standpoint of economy. The windings are wound simultaneously on automatic machines, their individual turns are close to each other and thus readily induce a field one into the other. However, as a result of the use of such a winding, it is difficult to obtain a substantial difference in resistance as between the two coils, since the automatic winding equipment will not accommodate wires of substantially different size.

FIG. 4 illustrates a preferred oscillator circuit for operating the buzzer, taking into account the slight difference in resistance of the two windings L1 and L2. When a difference in potential is initially applied to the terminals, as indicated, current flows through resistor R and the potential at the base connection of transistor T is at a value where the transistor will switch to its conductive state, allowing current to flow through coil L1. The base circuit potential rises because, although the D.C. resistance of coil L2 is not greatly different than that of coil L1, the diode D is chosen to match the transistor.

Current flowing through coil L1 creates a flux in the core, attracting magnet 36. At the same time, sufficient current is induced in coil L2 to hold the transistor in its conductive state. As the current rise through coil L1 levels off, the current induced in coil L2 will drop, the transistor comes out of saturation and the current through coil L1 will start to drop. The polarity of the current induced in coil L2 then reverses, and the transistor is switched off. This sequence occurs in rapid and regular fashion, the frequency of which determines the audible sound produced.

The modular construction of the buzzer permits its attachment to circuit boards in accordance with a standard dual-in-line package layout, or to a standard socket where replacement of the buzzer may be expected from time to time, or where its use is an option. Two of the pins 31 are adapted for connection to a power supply which may be controlled for example by a warning circuit (not shown). The other pins may merely provide a mechanical mounting connection, or one of them may provide a gating signal output at the buzzer frequency to some other warning or signalling device such as a small lamp.

While the forms of apparatus herein described constitute preferred embodiments of this invention, it is to be understood that the invention is not limited to these precise forms of apparatus, and that changes may be made therein without departing from the scope of the invention.

What is claimed is:

1. A buzzer for providing an audible warning, comprising a housing including a rectangular base corresponding in size and shape to a standard dual-in-line electronic package configuration, said housing having side walls hermetically sealed to and extending from said base defining an elongated enclosure and a thin stiff top wall molded and sealed to said side walls opposite said base in spaced relation to said base, an U-shaped armature of magnetic material such as iron, said base having a recess receiving the bottom of said armature with the legs of said armature projecting upward within said housing, a striker arm secured to one of said legs and extending lengthwise of said housing directly beneath said top wall to a location above the other said leg, said arm being arranged to oscillate toward and away from said other leg and to strike said top wall to produce an audible sound, electronic oscillator circuit means including a board fitted over the bottom of said armature and about at least said other leg of said armature, said circuit means also comprising electronic components supported on said board including induction coils surrounding said other leg to induce current in said armature to cause oscillation of said arm, mounting pins projecting from said base according to standard dual-in-line package configuration, some of said pins being connected to said circuit means internally of said housing, and said pins being fastened to said board holding said armature in position between said base and said board.

* * * * *